US008976211B2

(12) United States Patent
Mimura

(10) Patent No.: US 8,976,211 B2
(45) Date of Patent: Mar. 10, 2015

(54) IMAGE FORMING APPARATUS, ERASING DEVICE, IMAGE ERASING SYSTEM, AND CONSUMABLE

(75) Inventor: Toshifumi Mimura, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 111 days.

(21) Appl. No.: 13/523,987

(22) Filed: Jun. 15, 2012

(65) Prior Publication Data

US 2012/0327154 A1 Dec. 27, 2012

Related U.S. Application Data

(60) Provisional application No. 61/500,357, filed on Jun. 23, 2011.

(51) Int. Cl.
*B41M 7/00* (2006.01)
*B41J 2/32* (2006.01)

(52) U.S. Cl.
CPC ..... *B41J 2/32* (2013.01); *B41J 2202/37* (2013.01)
USPC ..... 347/179

(58) Field of Classification Search
None
See application file for complete search history.

(56) References Cited

U.S. PATENT DOCUMENTS

| | | | | |
|---|---|---|---|---|
| 5,394,231 | A | 2/1995 | Sudo et al. | |
| 7,904,011 | B2 * | 3/2011 | Arizumi et al. | 399/340 |

FOREIGN PATENT DOCUMENTS

| | | |
|---|---|---|
| JP | 06-161321 | 6/1994 |
| JP | 06-308860 | 11/1994 |
| JP | 2001-247807 | 9/2001 |
| JP | 2006-150700 | 6/2006 |
| JP | 2006-350200 | 12/2006 |
| JP | 2007-328293 | 12/2007 |

* cited by examiner

*Primary Examiner* — Lamson Nguyen
(74) *Attorney, Agent, or Firm* — Amin, Turocy & Watson, LLP

(57) ABSTRACT

According to one embodiment, an image forming apparatus that forms an image on a medium includes an image forming material erasable by heat, a storage medium having stored therein information concerning temperature for heating the image forming material, and a controller configured to control an image forming operation on the basis of the information concerning the temperature stored in the storage medium. The information concerning the temperature includes forming temperature, which is temperature for heating the image forming material during image formation, and erasing temperature, which is temperature for heating the image forming material during image erasing.

9 Claims, 11 Drawing Sheets

IMAGE FORMING APPARATUS, ERASING DEVICE, IMAGE ERASING SYSTEM, AND CONSUMABLE

CROSS-REFERENCE TO RELATED APPLICATIONS

This application is based upon and claims the benefit of U.S. Provisional Application No. 61/500,357, filed on Jun. 23, 2011; the entire contents of which are incorporated herein by reference.

FIELD

Embodiments described herein relate generally to an image forming apparatus, an erasing device, an image erasing system, and a consumable.

BACKGROUND

It is a general practice to print information on paper and check the information using an image forming apparatus such as an MFP (Multi Function Peripheral). A quantity of use of paper increases according to an increase in an information amount.

However, most of prints printed in this way are not required to be preserved and are temporarily recorded and discarded in a short period. Because of increasing awareness of environmental issues such as protection of forest resources, which are paper raw materials, and a reduction in carbon dioxide emission, use of reverse side paper, duplex printing, use of recycled paper, and the like are commonly performed. Further, as a method of enabling repeated use of paper, there are known a method of mechanically or chemically peeling an image forming material (e.g., a toner) on paper and a method of using an erasable toner, which is erased by heat, light, a chemical, or the like, for printing.

Printing and erasing with the erasable toner are repeated to realize protection of forest resources and a reduction in carbon dioxide emission using paper plural times. If an erasable toner, which is erased by heat, is used, in some cases, erasing temperature varies and erasing unevenness occurs because of variations in raw materials of the erasable toner. Therefore, the erasing temperature of an erasing device is often set rather high. As a result, a paper curl, the shine or gloss of an erasing mark, high-temperature offset, and the like sometimes occur. On the other hand, if the erasing temperature of the erasing device is set rather low, erasing unevenness sometimes occurs to deteriorate visibility when printing is performed next time using erased paper.

DETAILED DESCRIPTION

In general, according to one embodiment, an image forming apparatus that forms an image on a medium includes: an image forming material erasable by heat; a storage medium having stored therein information concerning temperature for heating the image forming material; and a controller configured to control an image forming operation on the basis of the information concerning the temperature stored in the storage medium. The information concerning the temperature includes forming temperature, which is temperature for heating the image forming material during image formation, and erasing temperature, which is temperature for heating the image forming material during image erasing.

First Embodiment

An MFP (Multi Function Peripheral), which is an image forming apparatus of an electrophotographic system, is explained below as an example of an image forming apparatus according to an embodiment of the present invention. The MFP is a digital compound machine not only for scanning, reading, and copying an image at designated resolution and in a designated sheet size but also for comprehensively utilizing various functions of office equipment such as an image receiving function by facsimile, an image receiving function by E-mail, and a printed image receiving function by network.

Figure 1:
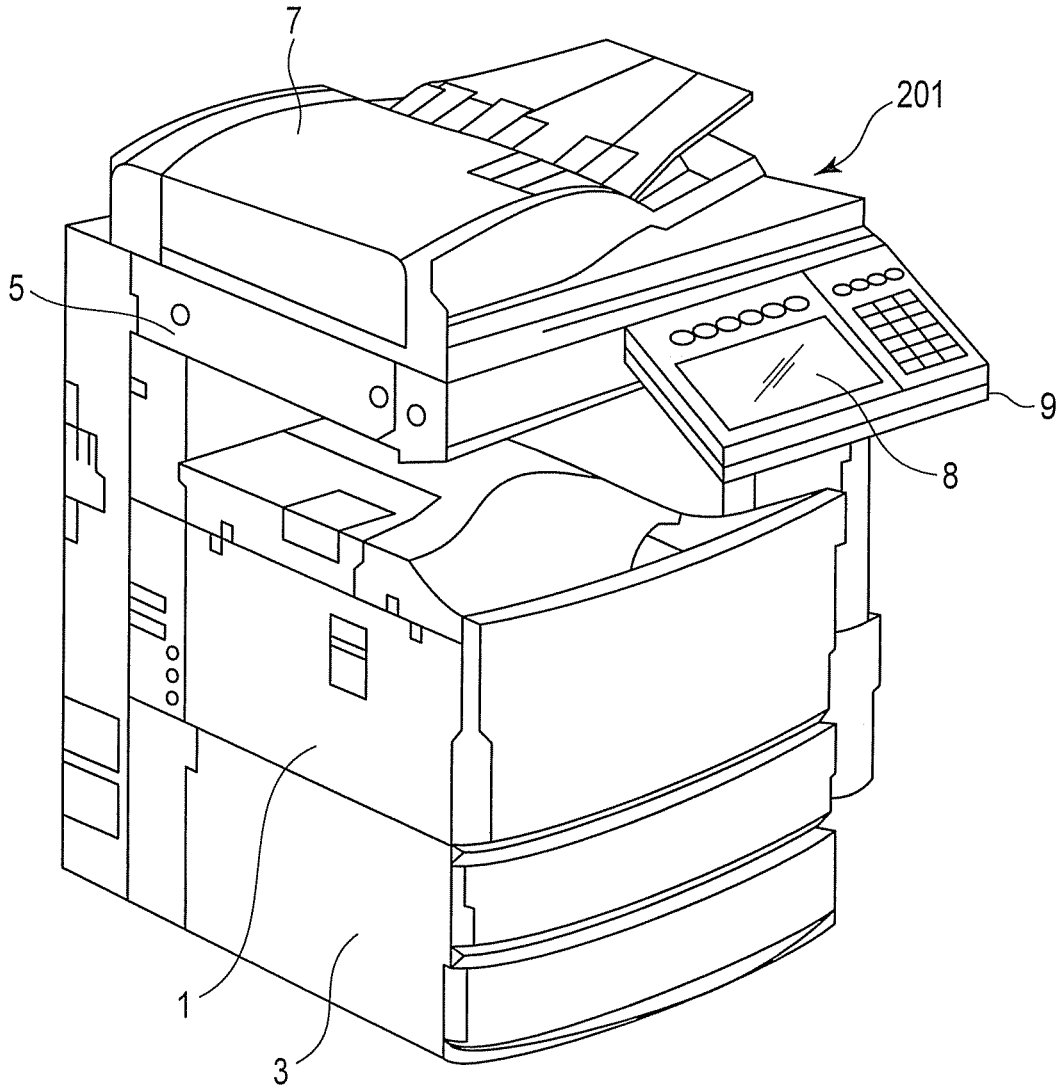
FIG. 1 is an exemplary perspective view of a schematic shape of an MFP according to a first embodiment.

FIG. 1 is an exemplary perspective view of a schematic shape of an image forming apparatus according to a first embodiment.

An MFP 201 includes a print section 1, a sheet tray 3, a scan section 5, an auto-feed section 7, and an operation panel 9.

The print section 1 outputs image information as an output image called, for example, hardcopy or printout. The sheet tray 3 feeds a medium, which is a sheet of an arbitrary size, used for image output to the print section 1. The scan section 5 captures image information from an original document as image data. The auto-feed section 7 delivers the original document, for which reading ends, from a reading position to a discharge position and leads the next original document to the reading position. The operation panel 9 is an instruction input section for instructing operations of the MFP 201 such as the start of image formation in the print section 1 and the start of reading of image information of an original document by the scan section 5. The operation panel 9 includes a display section 8, which includes an LCD (Liquid Crystal Device), for receiving the input of an instruction and displaying information to an operator.

Further, the MFP 201 can be connected to a not-shown network or communication line and receive image data by facsimile or E-mail.

An image forming operation in the image forming apparatus is explained.

Figure 2:
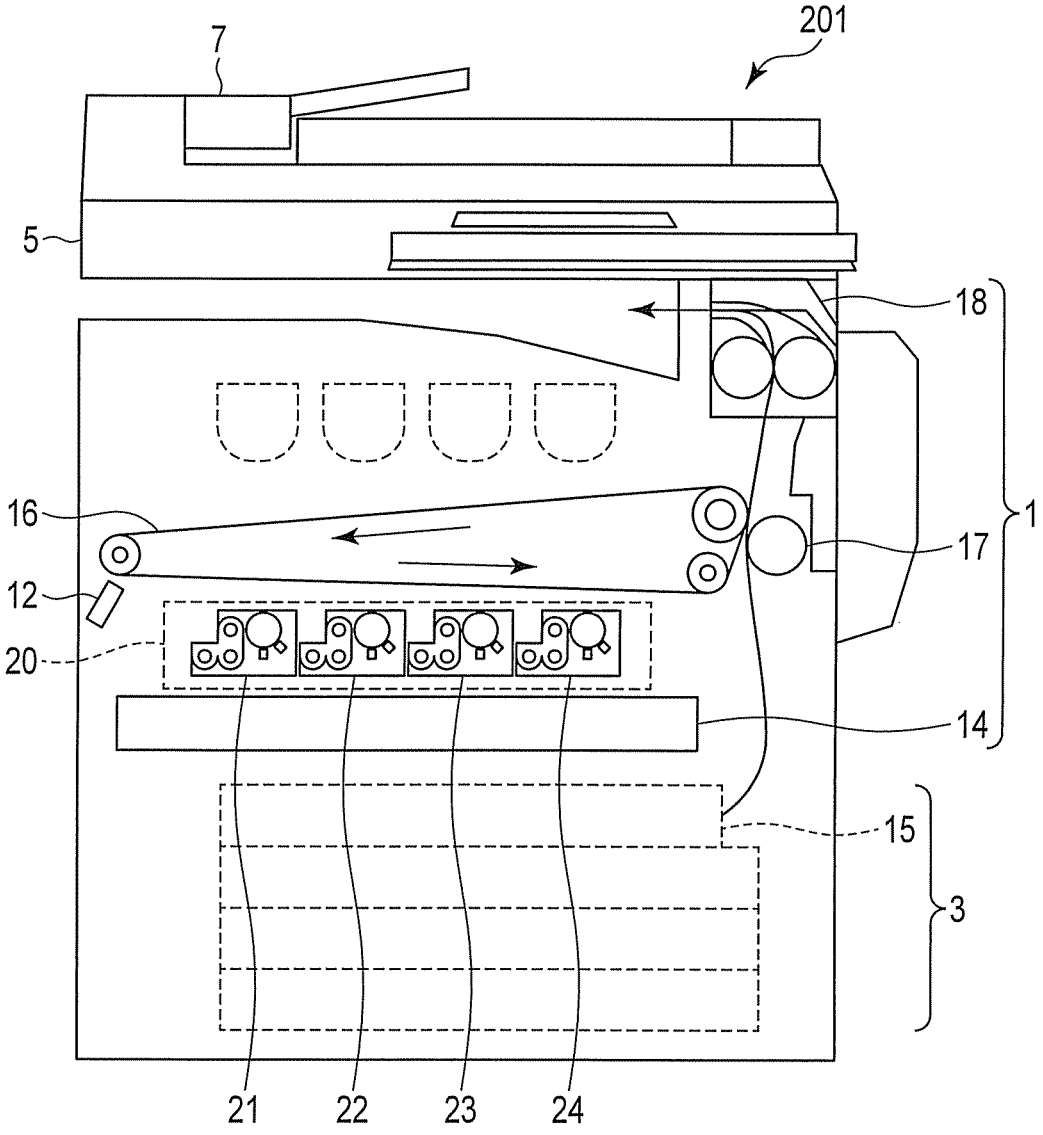
FIG. 2 is an exemplary schematic configuration diagram of the MFP according to the first embodiment.

FIG. 2 is an exemplary schematic configuration diagram of the image forming apparatus according to the first embodiment. The MFP 201 is an image forming apparatus in which a multiple tandem process is used. The MFP 201 includes a multiple tandem process 20, a blade 12 (a toner removing section), a control device 14, a paper feeding device 15, a primary transfer belt 16, a secondary transfer roller 17, and a fixing device 18. The multiple tandem process 20 includes four process units 21, 22, 23, and 24.

Figure 3:
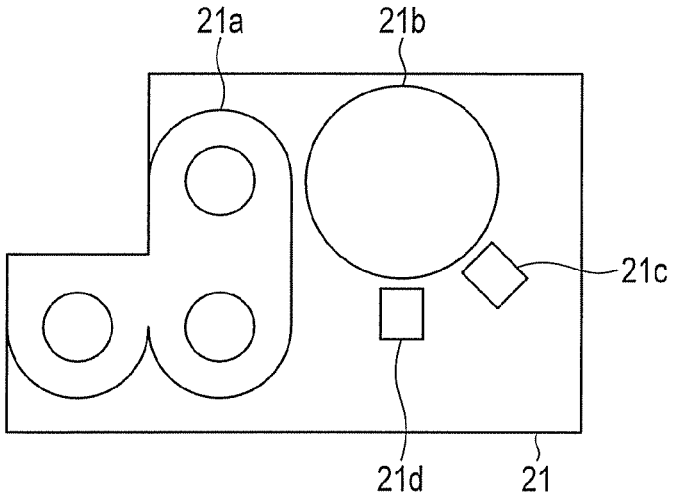
FIG. 3 is an exemplary configuration diagram of an example of the configuration of a process unit of the MFP according to the first embodiment.

FIG. 3 is an exemplary configuration diagram of an example of the configuration of the process unit 21 of the image forming apparatus according to the first embodiment. The process unit 21 includes a developing device 21*a*, a photoconductive drum 21*b*, a charging device 21*c*, and an exposing device 21*d*.

In the process unit 21, the photoconductive drum 21*b* (an image bearing member) is charged to predetermined potential by the charging device 21*c*. A laser beam intensity-modulated according to image information is irradiated on the photoconductive drum 21*b* by the exposing device 21*d*. Consequently, an electrostatic latent image corresponding to an image, which should be output, is formed on the photoconductive drum 21*b*. The electrostatic latent image formed on the photoconductive drum 21*b* is selectively provided with a toner by a magnetic brush of the developing device 21*a* and developed. A developed toner image on the photoconductive drum 21*b* is transferred onto the primary transfer belt 16 by an electric field. The process unit 21 is a cleaner-less type. However, the process unit 21 is not limited to this type and may include a cleaner. The configuration and the operation of the other process units 22, 23, and 24 are the same as above.

The process units 21, 22, 23, and 24 may use plural erasable toners having colors different from one another or may use at least one erasable toner.

A bond of a coloring matter and a color developing agent of the erasable toner is cut off by heat, whereby erasing is performed. For the erasing of a toner image, it is necessary to heat a sheet at temperature equal to or higher than predetermined temperature, for example, at 120° C. to 150° C.

In the MFP 201 shown in FIG. 2, respective color toner images are transferred onto the primary transfer belt 16 through an image forming process by the process units 21, 22, 23, and 24. Thereafter, a sheet is fed and discharged from the MFP 201 through a secondary transfer process by the secondary transfer roller 17 and a fixing process by the fixing device 18.

Figure 4:
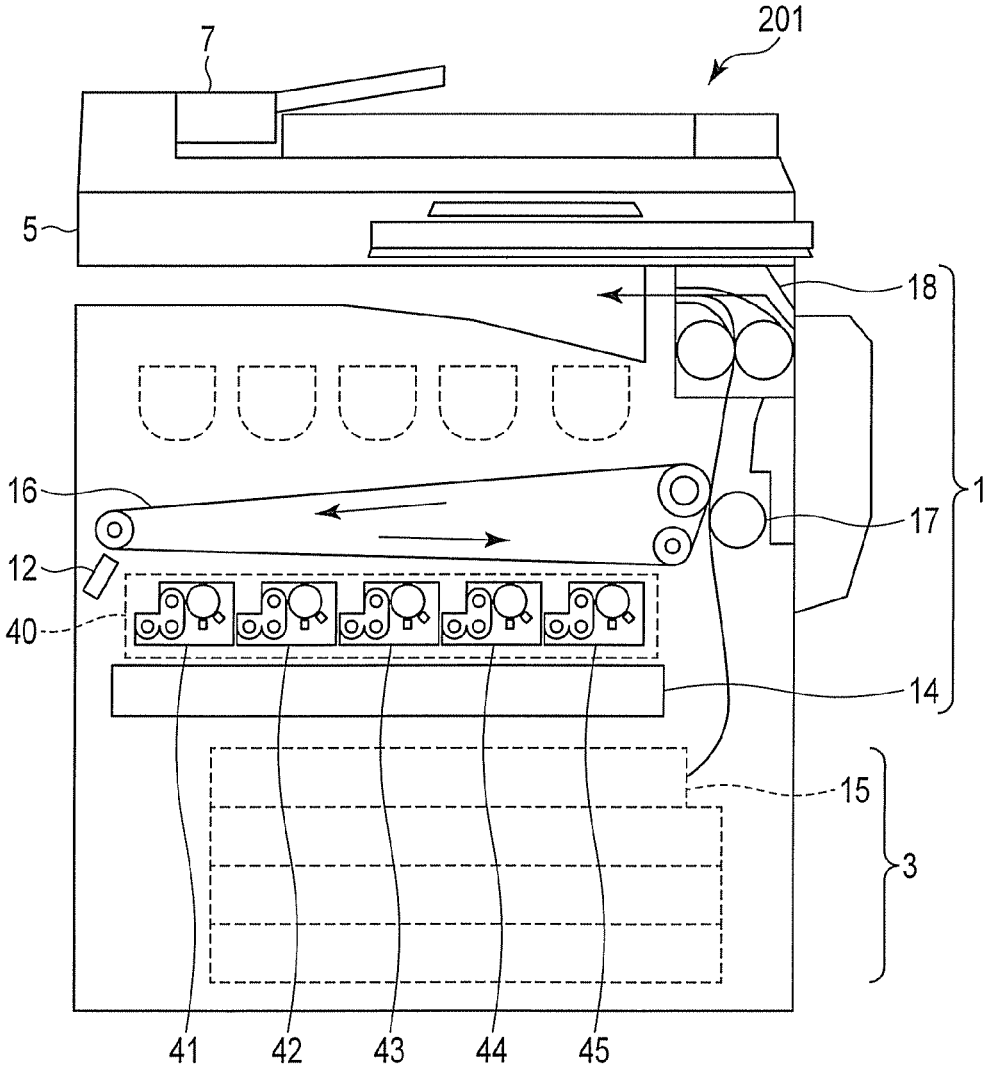
FIG. 4 is another exemplary schematic configuration diagram of the MFP according to the first embodiment.

The MFP 201 is not limited to the configuration shown in FIG. 2 and may have a configuration shown in FIG. 4. The MFP 201 shown in FIG. 4 includes a multiple tandem process 40 instead of the multiple tandem process 20. The multiple tandem process 40 includes, for example, a process unit 41 that uses an erasable toner and process units 42, 43, 44, and 45 that use unerasable toners of four colors.

Figure 5:
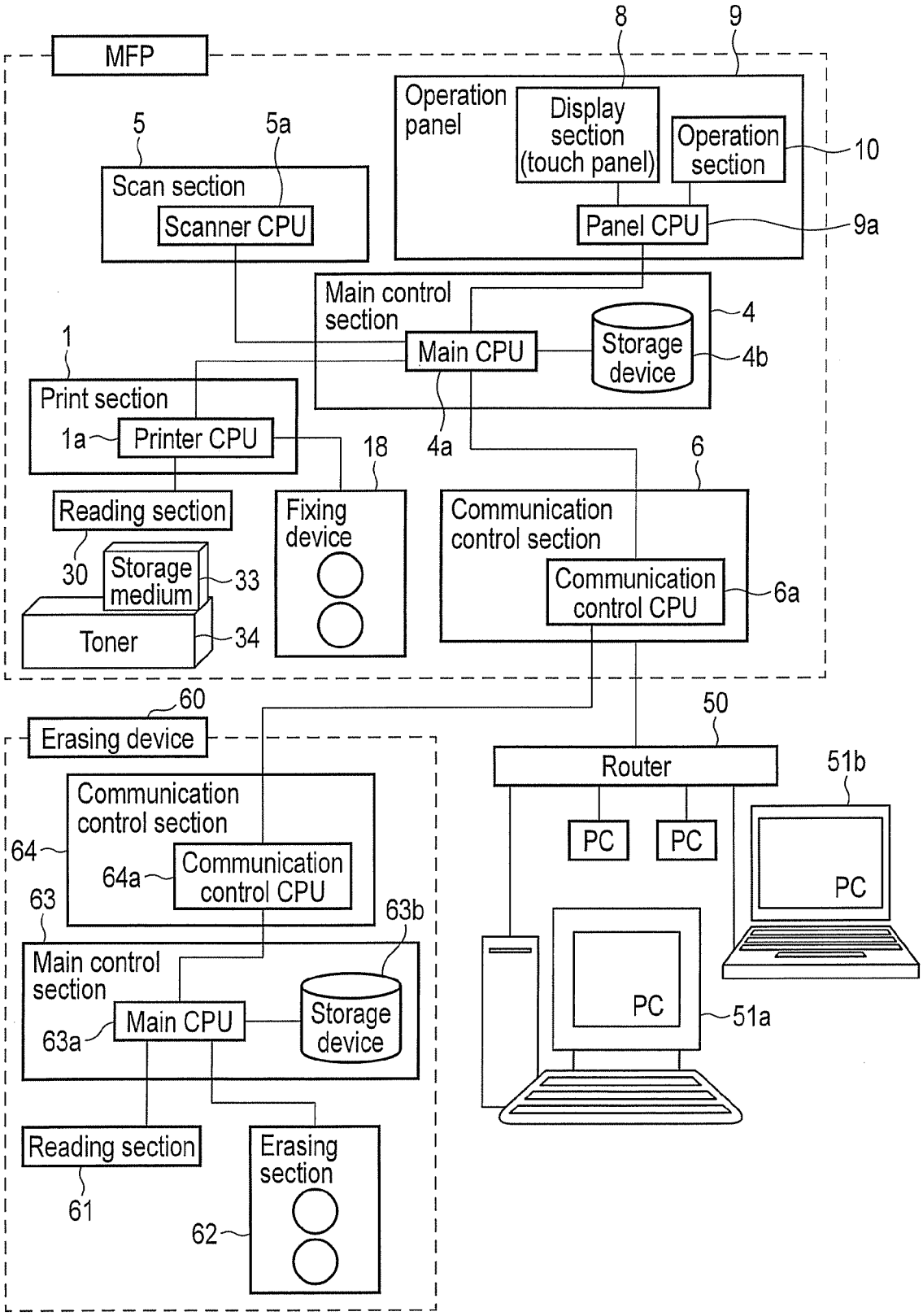
FIG. 5 is an exemplary diagram of a connection state of the configuration of a control system of the MFP according to the first embodiment and external apparatuses.

FIG. 5 is an exemplary diagram of a connection state of the configuration of a control system of the MFP 201 according to the first embodiment and external apparatuses.

The MFP 201 includes five CPUs (Central Processing Units), i.e., a main CPU 4*a* in the main control section 4, a scanner CPU 5*a* of the scan section 5, a printer CPU 1*a* of the print section 1, a panel CPU 9*a* of the operation panel 9, and a communication control CPU 6*a* of a communication control section 6.

The main CPU 4*a* collectively controls the MFP 201. The main control section 4 includes a storage device 4*b*. A computer program for controlling the operation of the MFP 201, image information, and the like are stored in the storage device 4*b*.

The main CPU 4*a* performs bidirectional communication with the printer CPU 1*a* via a shared RAM (Random Access Memory). The main CPU 4*a* outputs an operation instruction. The printer CPU 1*a* returns a status of the state of the print section 1. The printer CPU 1*a* and the scanner CPU 5*a* exchange information through serial communication. The printer CPU 1*a* outputs an operation instruction. The scanner CPU 5*a* returns a status of the state of the scan section 5.

The operation panel 9 includes the display section 8 including the touch panel as explained above, an operation section 10 including various operation keys, and the panel CPU 9*a* connected to the display section 8 and the operation section 10. The panel CPU 9*a* is connected to the main CPU 4*a* and performs exchange of information.

The communication control CPU 6*a* is an interface that performs exchange of information with plural PCs (Personal Computers) 51*a* to 51*b*, which are external apparatuses, and an erasing device 60 via a router 50. The main CPU 4*a* is connected to the communication control CPU 6*a* and exchanges information with the external apparatuses. In an example explained herein, the information is exchanged by wire. However, it goes without saying that the information may be exchanged by radio using an electromagnetic wave.

The MFP 201 includes a consumable including a storage medium 33. Further, the MFP 201 includes a reading section 30 that reads out information from the storage medium 33. The reading section 30 is a contact type or a noncontact type according to the type of the storage medium 33. In FIG. 5, a toner 34 including the storage medium 33 is disclosed as an example of the consumable. The erasable toner 34 used in the MFP 201 has a characteristic that the erasable toner 34 is fixed at 95° C. and erased or otherwise decolorized at 110° C. However, both of the fixing temperature and the erasing temperature have variations according to variations in toner raw materials and variations in manufacturing conditions. The printer CPU 1*a* of the print section 1 reads information of the storage medium 33 via the reading section 30, transmits the information to the main CPU 4*a*, and controls the fixing device 18 on the basis of the information.

The consumable is not limited to the toner 34 and may be a toner cartridge. The storage medium 33 may be configured using an IC chip, an RFID (Radio Frequency IDentification), or the like and may be a barcode or a QR code.

The erasing device 60, which is the external apparatus, includes a reading section 61, an erasing section 62, a main control section 63, and a communication control section 64. The erasing section 62 heats and erases an image formed on a sheet with an erasable toner. The reading section 61 reads information concerning the erasable toner printed on the sheet (details are explained later). The communication control section 64 performs exchange of information with the MFP 201 via a communication control CPU 64*a*. A main CPU 63*a* of the main control section 63 collectively controls the sections of the erasing device 60. A storage device 63*b* stores information related to a control operation of the main control section 63.

A cooperated operation concerning erasing by the MFP 201 and the erasing device 60 according to the first embodiment is explained.

Figure 6:
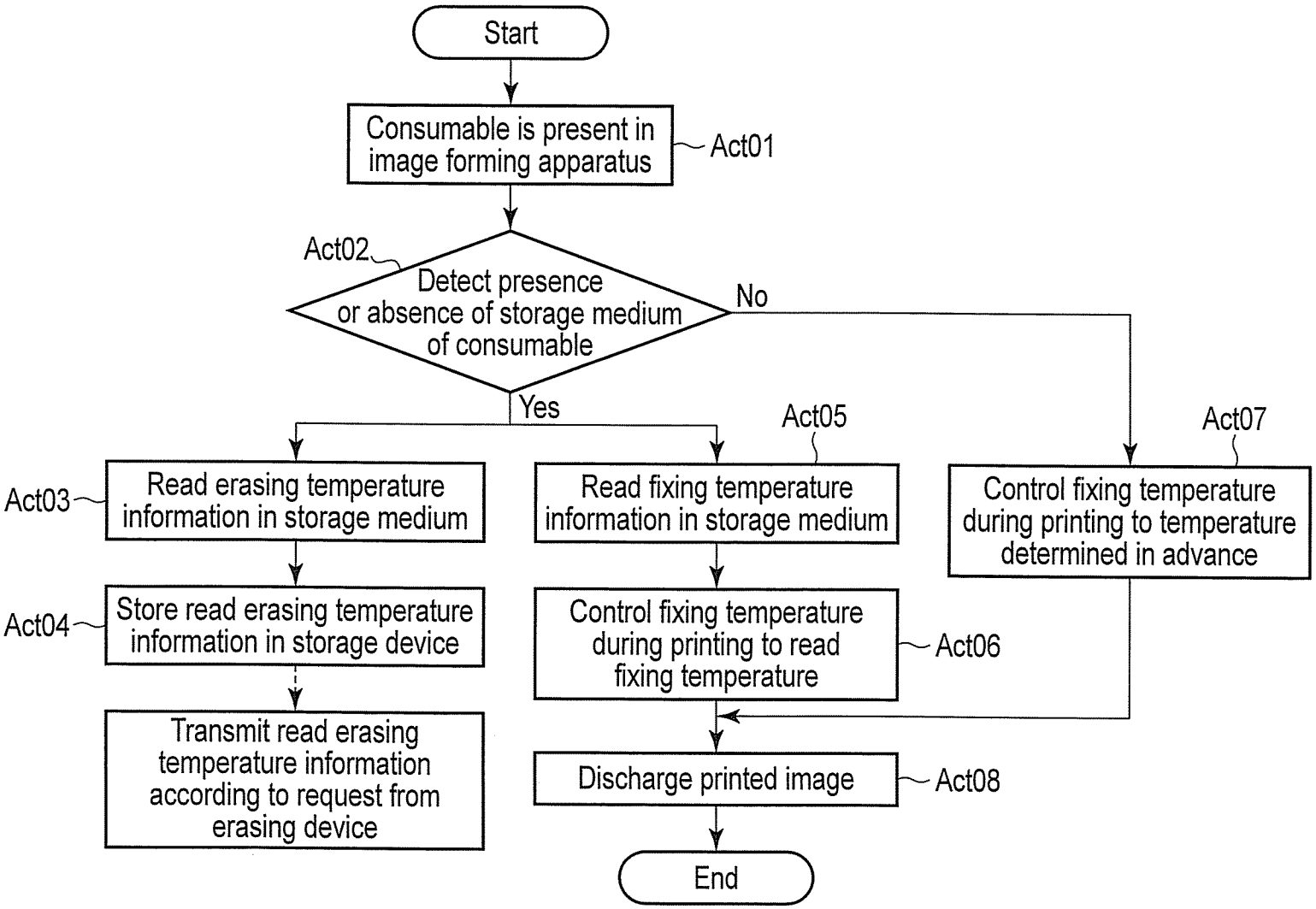
FIG. 6 is an exemplary flowchart for explaining an operation procedure concerning erasing by the MFP according to the first embodiment.

FIG. 6 is an exemplary flowchart for explaining an operation procedure concerning erasing by the MFP 201 according to the first embodiment.

An operation start button for the MFP 201 is operated on the operation panel 9, in Act 01, the main control section 4 detects that the consumable for erasing (the toner) 34 is present. In Act 02, the printer CPU 1*a* detects whether the storage medium 33 is present in a predetermined position of the toner 34.

If the printer CPU 1*a* detects that the storage medium 33 is present (YES in Act 02), the printer CPU 1*a* reads information concerning erasing of the toner 34 stored in the storage medium 33. The information concerning erasing includes erasing temperature, fixing temperature, and the like of the erasable toner.

In Act 03, the printer CPU 1*a* reads the information concerning the erasing temperature of the erasable toner. In Act 04, the main CPU 4*a* stores the read information concerning the erasing temperature of the erasable toner in the storage device 4*b*. The main CPU 4*a* transmits the read information concerning the erasing temperature to the erasing device 60 in response to a request from the erasing device 60. The main CPU 4*a* does not always transmit the read information concerning the erasing temperature in response to the request from the erasing device 60. The main CPU 4*a* may periodically transmit the read information concerning the erasing temperature to the erasing device 60.

On the other hand, in Act 05, the printer CPU 1*a* reads the information concerning the fixing temperature of the erasable toner. In Act 06, the printer CPU 1*a* controls, on the basis of the read information concerning the fixing temperature, fixing temperature during printing with the toner 34 and obtains an image in an optimum fixed state. In Act 08, the fixing device 18 discharges a sheet on which the image is printed.

If the printer CPU 1*a* detects that the storage medium 33 is absent (NO in Act 02), in Act 07, the printer CPU 1*a* controls the fixing temperature to temperature determined in advance. In Act 08, the fixing device 18 discharges a sheet on which an image is printed. If information in the storage medium 33 may not be able to be read because of some reason even if the storage medium 33 is present, the MFP 201 performs operation same as the operation performed when the storage medium 33 is not present. The information in the storage medium 33 may not be able to be read, for example, if data in the storage medium 33 is broken or lost or if the information concerning the fixing temperature and the erasing temperature, which should be written in the storage medium 33, is not written in the storage medium 33 during manufacturing of the toner 34.

If the fixing temperature is controlled to the temperature determined in advance, naturally, since the fixing operation is not performed at temperature optimum for the toner 34, fixability could be deteriorated. The information concerning the erasing temperature is not transmitted to the erasing device 60.

The image formed on the sheet using the erasable toner is erased by the erasing device 60 after the image finishes a desired role.

Figure 7:
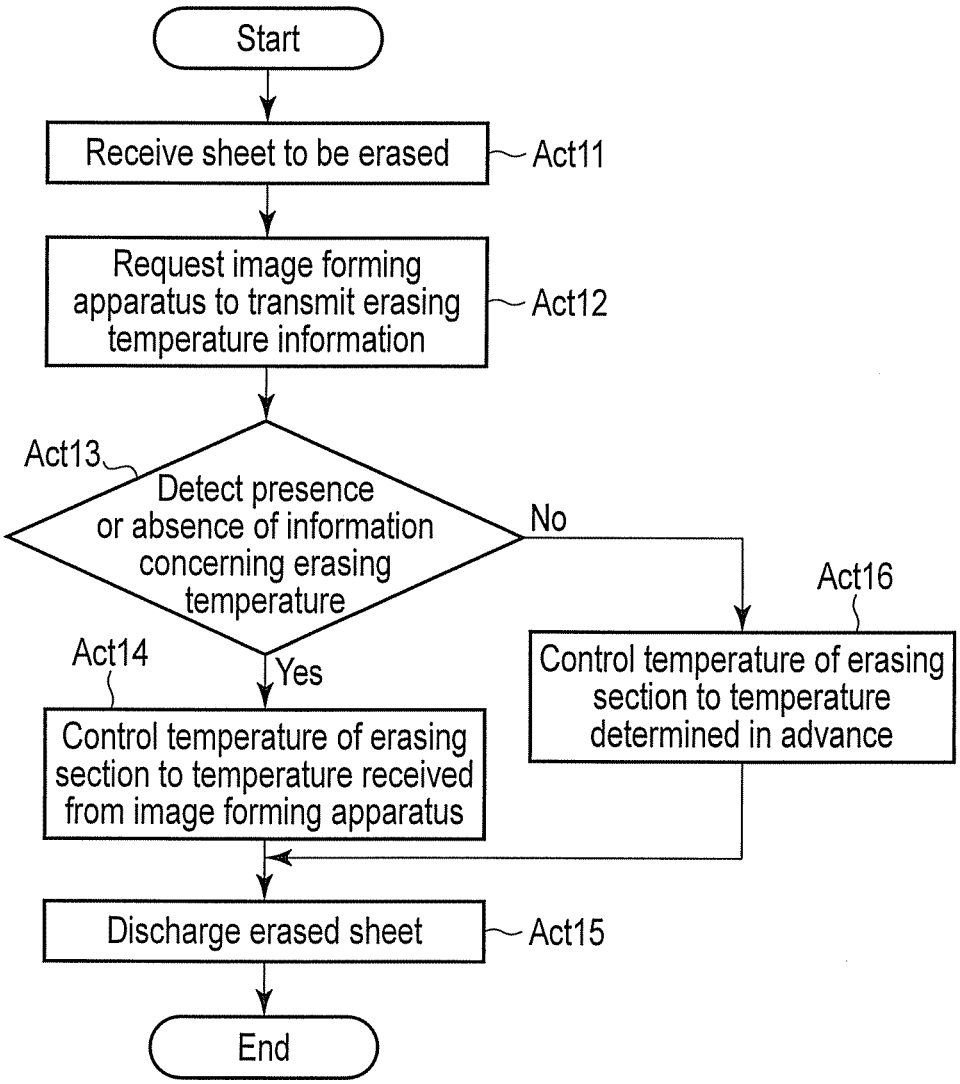
FIG. 7 is an exemplary flowchart for explaining an operation procedure concerning erasing by an erasing device according to the first embodiment.

FIG. 7 is an exemplary flowchart for explaining an operation procedure concerning erasing by the erasing device 60 according to the first embodiment.

When an erasing operation for an image to be erased is started, in Act 11, the main CPU 63*a* starts reception of a sheet on which the image to be erased is printed. In Act 12, the main CPU 63*a* requests, via the communication control CPU 64*a*, the MFP 201 to transmit information concerning the erasing temperature of the toner 34 that forms the image to be erased. In Act 13, the main CPU 63*a* waits for a response from the MFP 201.

If the information concerning the erasing temperature is received from the MFP 201 (YES in Act 13), in Act 14, the main CPU 63*a* controls the temperature of the erasing section 62 on the basis of the received information concerning the erasing temperature and erases the image. In Act 15, the erasing section 62 discharges the erased sheet.

On the other hand, if no response is received even if a fixed time elapses after the request for the erasing temperature to the MFP 201 (NO in Act 13), in Act 16, the main CPU 63*a* controls the erasing operation by the erasing section 62 at erasing temperature determined in advance. In Act 15, the erasing section 62 discharges the erased sheet.

No response is received even if the fixed time elapses, for example, if the storage medium 33 is absent in the toner 34 during the detection (in Act 02 in FIG. 6), if it is determined that the storage medium 33 is in a state equivalent to the absence of data, or if a communication state between the MFP 201 and the erasing device 60 is bad.

If the erasing temperature is controlled to the temperature determined in advance, naturally, it is not guaranteed that the erasing operation is performed at temperature optimum for the toner 34. Therefore, since erasing could not be sufficiently performed depending on a case, if an image is printed using an erased sheet, visibility of the printed image is sometimes deteriorated.

If the information concerning the erasing temperature of the toner 34 is periodically transmitted from the MFP 201 to the erasing device 60 as explained above, the erasing device 60 can obtain an optimum erased image by controlling the temperature of the erasing section 62 on the basis of latest erasing temperature information.

Second Embodiment

A cooperated operation concerning erasing by the MFP 201 and the erasing device 60 according to a second embodiment is explained. The second embodiment is different from the first embodiment in that information concerning erasing temperature is printed on a sheet. Components same as or similar to those in the first embodiment are denoted by the same reference numerals and signs and explanation of details of the components is omitted.

In the first embodiment, the operation for erasing in a short period is explained. However, in the second embodiment, a method applicable even if a period until erasing is long is explained.

Figure 8:
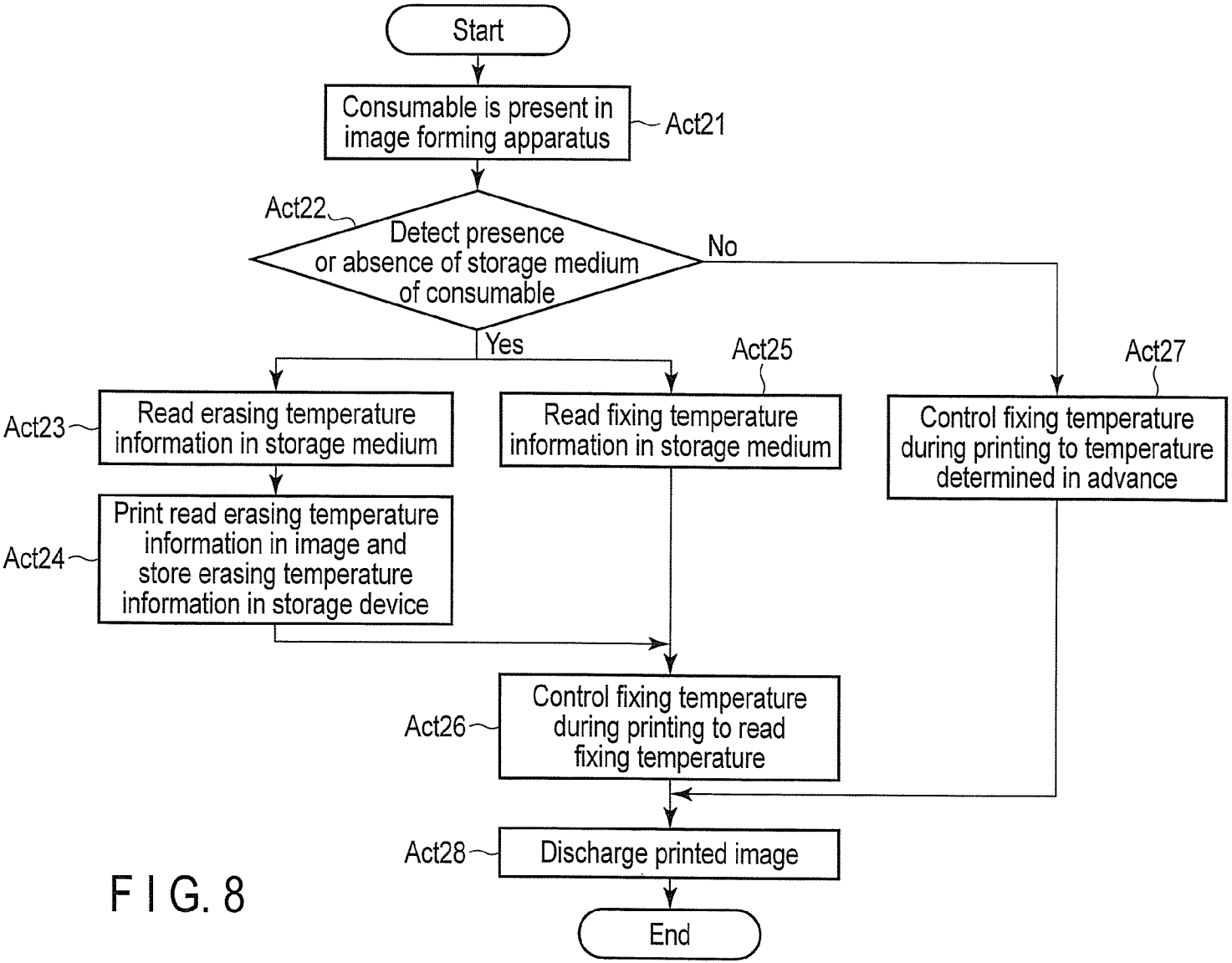
FIG. 8 is an exemplary flowchart for explaining an operation procedure concerning erasing by an MFP according to a second embodiment.

FIG. 8 is an exemplary flowchart for explaining an operation procedure concerning erasing by the MFP 201 according to the second embodiment.

When the operation start button for the MFP 201 is operated on the operation panel 9, in Act 21, the main control section 4 detects that the consumable for erasing (the toner) 34 is present. In Act 22, the printer CPU 1*a* detects whether the storage medium 33 is present in the predetermined position of the toner 34.

If the printer CPU 1*a* detects that the storage medium 33 is present (YES in Act 22), the printer CPU 1*a* reads information concerning erasing of the toner 34 stored in the storage medium 33. The information concerning erasing includes erasing temperature, fixing temperature, and the like of the erasable toner.

In Act 23, the printer CPU 1*a* reads the information concerning the erasing temperature of the erasable toner. In Act 24, the main CPU 4*a* forms, in an image, the read information concerning the erasing temperature of the erasable toner and stores the read information in the storage device 4*b*.

Figure 10:
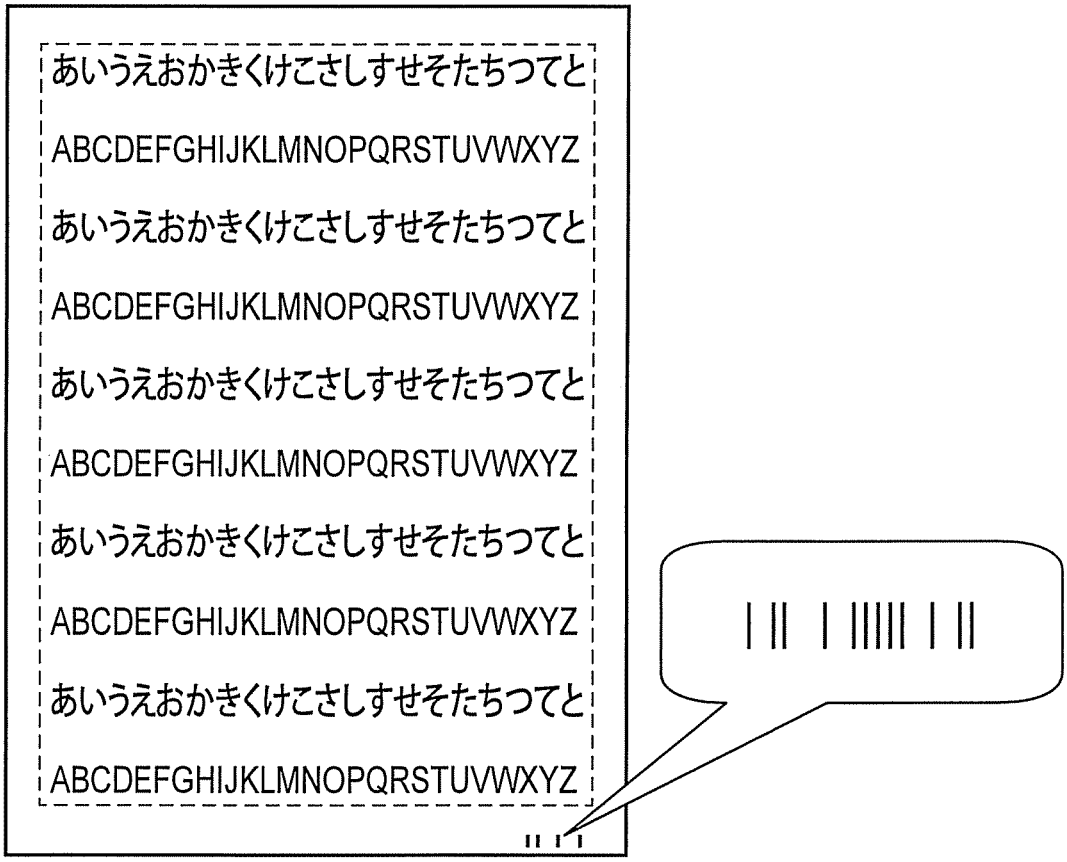
FIG. 10 is an exemplary diagram of a form of information formed in an image by the MFP according to the second embodiment.

FIG. 10 is an exemplary diagram of a form of the information formed in the image by the MFP 201 according to the second embodiment.

The information concerning the erasing temperature of the erasable toner 34 is formed in a non-image region 70 of a sheet. The non-image region 70 is a region excluding a region 71 set for printing an image in a region of the entire sheet.

In the non-image region 70 of the sheet, the information concerning the erasing, temperature of the erasable toner 34 is formed as a pattern. In FIG. 10, a barcode is shown as an example of the pattern. However, the pattern may be a QR code or a pattern having a shape similar to the barcode or the QR code. The information to be formed may be a row of characters or numbers which is seemingly meaningless. However, the pattern such as the barcode or the QR code is desirable to prevent the pattern from being confused with a print file name.

On the other hand, in Act 25 in FIG. 8, the printer CPU 1*a* reads the information concerning the fixing temperature of the erasable toner 34. In Act 26, the printer CPU 1*a* controls the fixing temperature of the toner 34 on the basis of the read information concerning the fixing temperature and obtains an image in an optimum fixed state. In Act 28, the fixing device 18 discharges a sheet on which the image is printed.

If the printer CPU 1*a* detects that the storage medium 33 is absent (NO in Act 22), in Act 27, the printer CPU 1*a* controls the fixing temperature to temperature determined in advance. In Act 28, the fixing device 18 discharges a sheet on which an image is printed.

The image formed on the sheet using the erasable toner is erased by the erasing device 60 after the image finishes a desired role.

Figure 9:
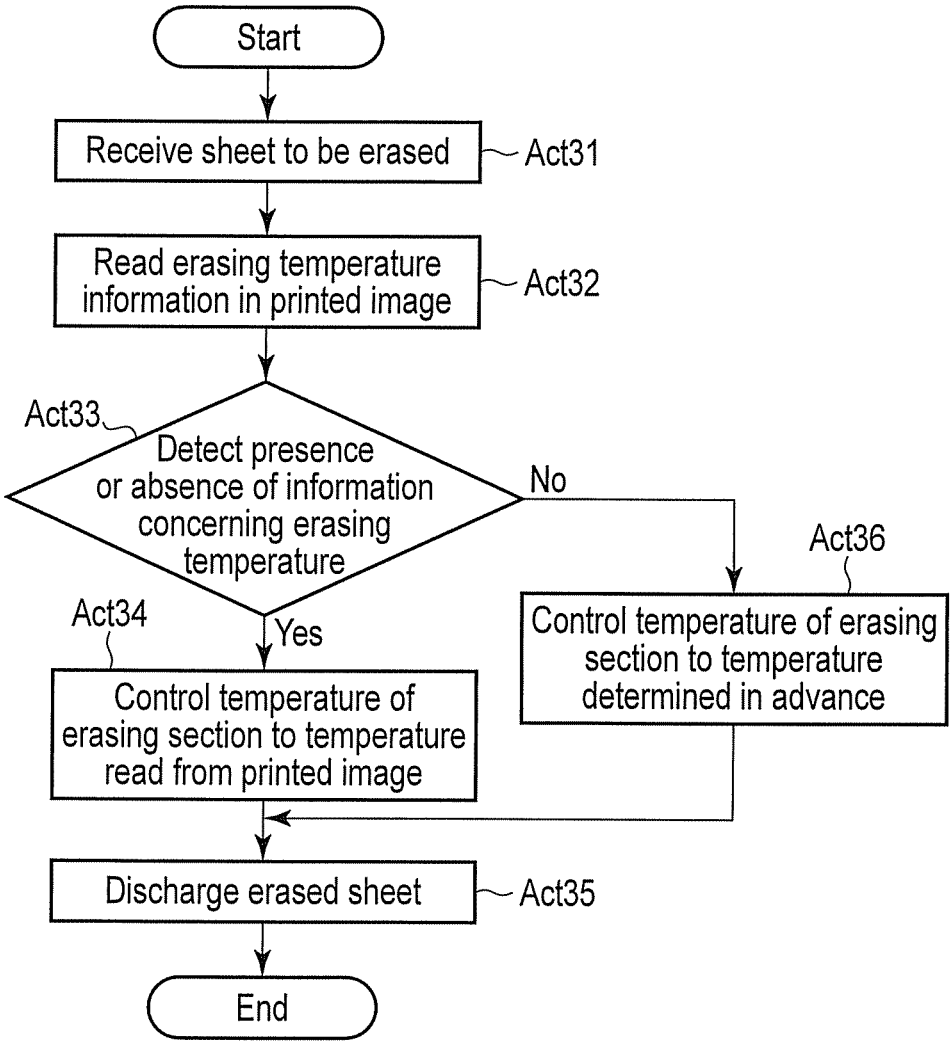
FIG. 9 is an exemplary flowchart for explaining an operation procedure concerning erasing by an erasing device according to the second embodiment.

FIG. 9 is an exemplary flowchart for explaining an operation procedure concerning erasing by the erasing device 60 according to the second embodiment.

When an erasing operation for an image to be erased is started, in Act 31, the main CPU 63*a* starts reception of a sheet on which the image to be erased is printed. In Act 32, the main CPU 63*a* reads, via the reading section 61, the pattern formed in the non-image region 70 and acquires information concerning the erasing temperature.

The sheet is not always read by the erasing device 60 in the same direction as a direction in which the sheet is printed. Therefore, the main CPU 63*a* needs to execute processing for extracting the pattern after applying rotation or the like to image data read by the reading section 61.

Even if the non-image region 70 is stained, in order to enable reading of the pattern, when the pattern is printed in the non-image region 70, the erasable toner 34 of a specific color can be used. For example, in the case of an erasable toner including a cyan color material, the wavelength of the printed pattern is 450 to 500 nm. Therefore, it is possible to reduce noise by extracting the pattern from the non-image region 70 using an optical filter (e.g., a band-pass filter that transmits light having the wavelength 450 to 500 nm).

If the information concerning the erasing temperature is acquired from the sheet (YES in Act 33), in Act 34, the main CPU 63*a* controls the temperature of the erasing section 62 on the basis of the acquired information concerning the erasing temperature and erases the image. In Act 35, the erasing section 62 discharges the erased sheet.

On the other hand, if the information concerning the erasing temperature is not acquired from the sheet (NO in Act 33), in Act 36, the main CPU 63*a* controls an erasing operation by the erasing section 62 at erasing temperature determined in advance. In Act 35, the erasing section 62 discharges the erased sheet.

Third Embodiment

A cooperated operation concerning erasing by the NFP 201 and the erasing device 60 according to a third embodiment is explained. The third embodiment is different from the second embodiment in that information concerning erasing temperature is printed on a sheet and communication means is used according to necessity. Components same as or similar to those in the second embodiment are denoted by the same reference numerals and signs and explanation of details of the components is omitted.

Figure 11:
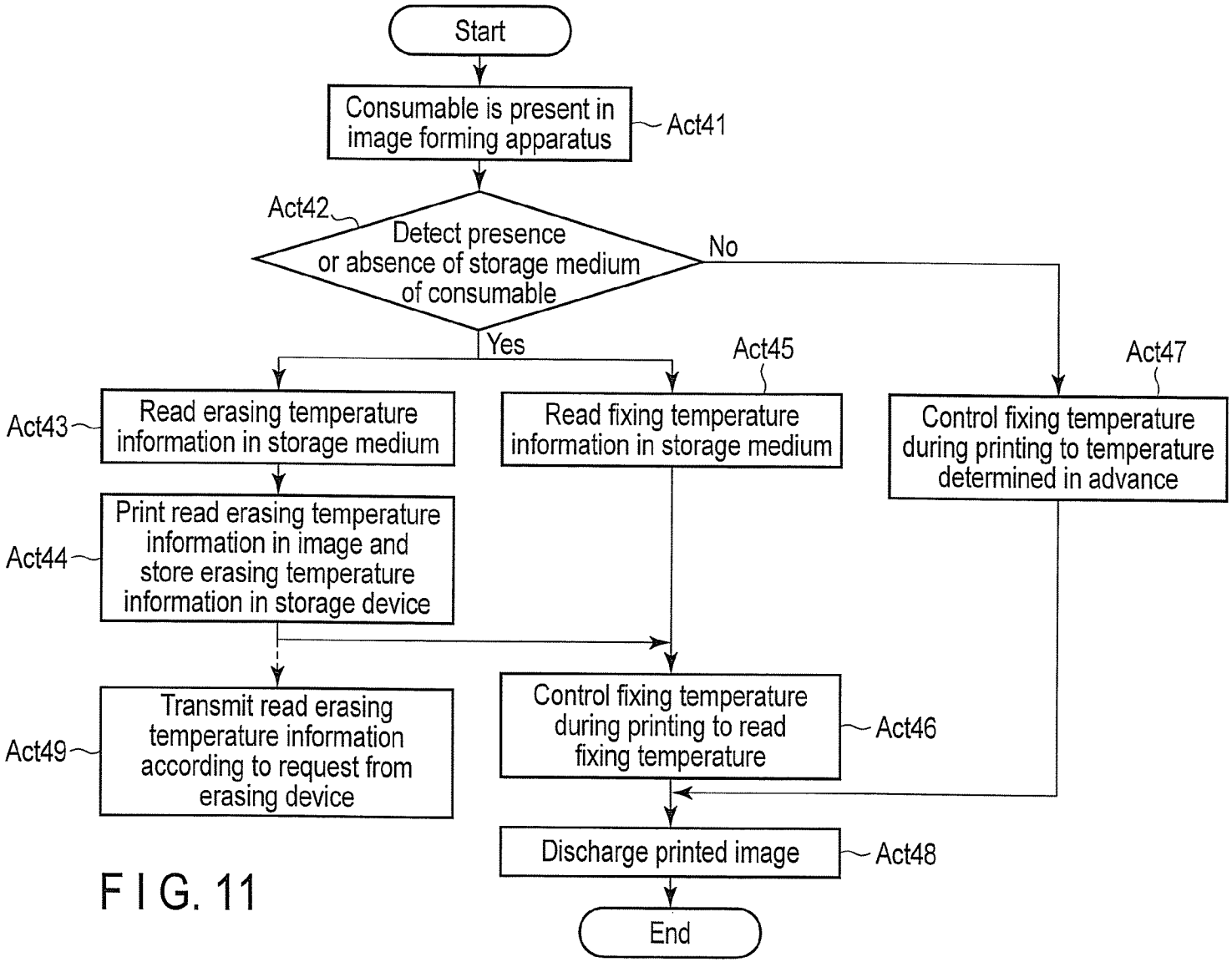
FIG. 11 is an exemplary flowchart for explaining an operation procedure concerning erasing by an MFP according to a third embodiment.

FIG. 11 is an exemplary flowchart for explaining an operation procedure concerning erasing by the MFP 201 according to the third embodiment.

A processing procedure in the third embodiment shown in FIG. 11 is the same as the processing procedure in the second embodiment shown in FIG. 8 except that, in Act 49, the MFP 201 transmits read information concerning erasing temperature in response to a request from the erasing device 60.

Figure 12:
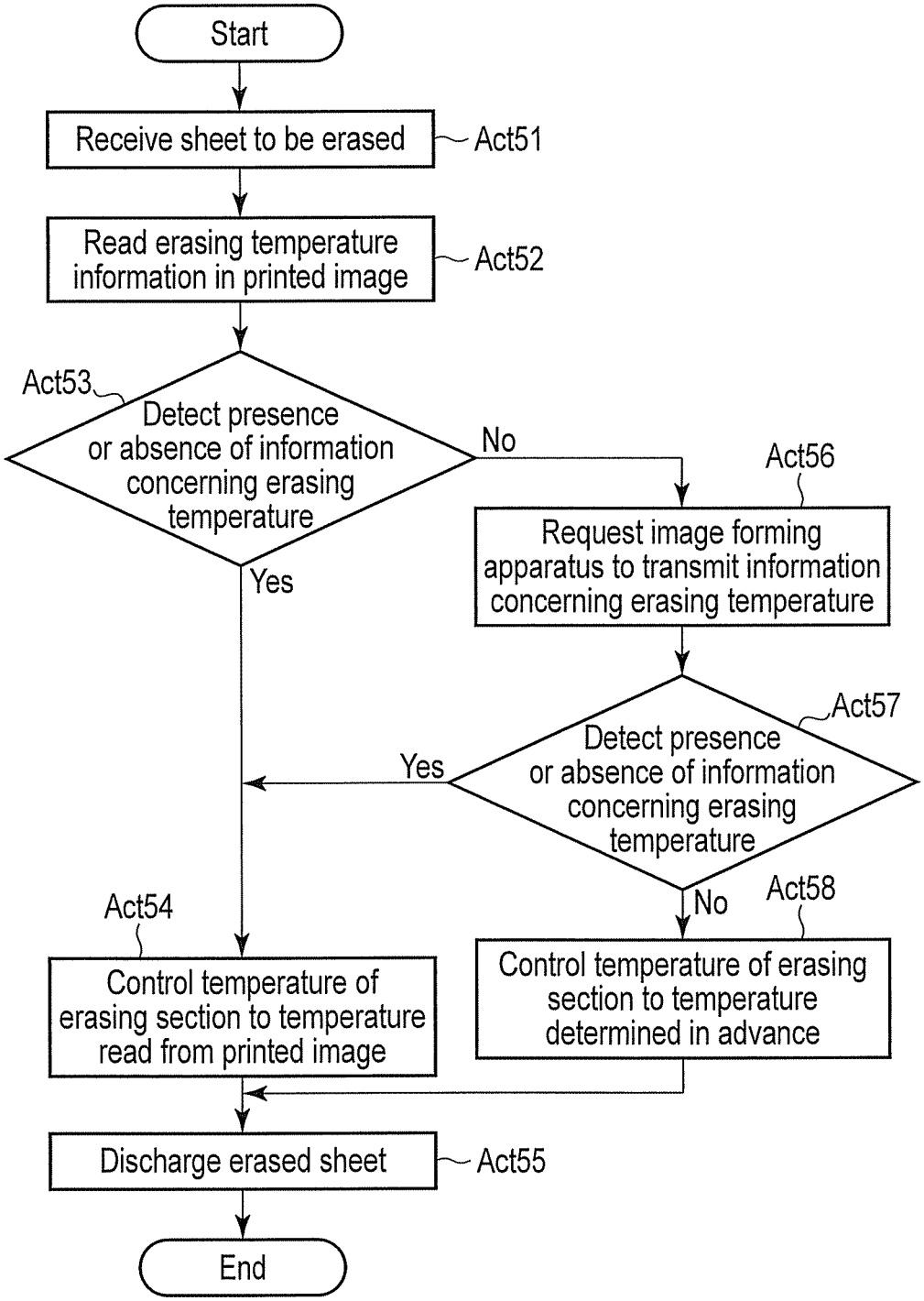
FIG. 12 is an exemplary flowchart for explaining an operation procedure concerning erasing by an erasing device according to the third embodiment.

FIG. 12 is an exemplary flowchart for explaining an operation procedure concerning erasing by the erasing device 60 according to the third embodiment.

Actions in Acts 51 to 55 shown in FIG. 12 are the same as the actions in Acts 31 to 35 in the second embodiment shown in FIG. 9.

If the information concerning the erasing temperature is not acquired from the sheet (NO in Act 53), in Act 56, the main CPU 63*a* requests, via the communication control CPU 64*a*, the MFP 201 to transmit information concerning the erasing temperature of the toner 34 that forms the image to be erased. In Act 57, the main CPU 63*a* waits for a response from the MFP 201.

If the information concerning the erasing temperature is received from the MFP 201 (YES in Act 57), in Act 54, the main CPU 63*a* controls the temperature of the erasing section 62 on the basis of the received information concerning the erasing temperature and erases the image. In Act 55, the erasing section 62 discharges the erased sheet.

On the other hand, if the information concerning the erasing temperatures is not received from the MFP 201 (NO in Act 57), in Act 58, the main CPU 63*a* controls the erasing operation by the erasing section 62 at erasing temperature determined in advance. In Act 55, the erasing section 62 discharges the erased sheet.

Modification of the First to Third Embodiments

A cooperated operation concerning erasing by the MFP 201 and the erasing device 60 according to a modification of the first to third embodiments is explained on the basis of the second embodiment. In the modification, information concerning erasing temperature printed on a sheet is different from that in the second embodiment.

In Act 24 in FIG. 8, the main CPU 4*a* forms the read information concerning the erasing temperature of the erasable toner in a non-image region and stores the information in the storage device 4*b*. Further, the main CPU 4*a* forms, in an image, data of the present date and time.

In Act 34 in FIG. 9, if date and time in the printed image is further in the past than the present by predetermined time, the erasing device 60 sets temperature in the fixing device 18 higher than the erasing temperature by predetermined temperature (a). Consequently, even on a sheet used when a long time elapses after printing with the erasable toner, it is possible to prevent occurrence of unevenness due to the toner remaining without being erased.

By adopting the configuration explained above, it is possible to obtain an image in which both of stable fixing characteristics and erasing characteristics are realized.

In the embodiments, the MFP 201 and the erasing device 60 are configured to be separated from each other. However, the MFP 201 and the erasing device 60 may be configured to be integrated. For example, the erasing device 60 may be incorporated in the MFP 201 or the fixing device 18 may be configured to be capable of functioning as an erasing device.

In the embodiments, the image forming apparatus of the electrophotographic system is explained. However, the present invention can also be applied to an image forming apparatus of an inkjet system. When the present invention is applied to the image forming apparatus of the inkjet system, liquid ink or gel ink is used rather than a toner. Fixing temperature can be grasped as heating temperature.

The functions explained in the embodiments may be configured using hardware. The functions may be realized by causing a computer to read a computer program that describes the functions using software. The functions may be configured by selecting the software or the hardware as appropriate.

Further, the functions can also be realized by causing the computer to read the computer program stored in a not-shown recording medium. A recording form of the recording medium in the embodiments may be any form as long as the recording medium can record the computer program and can be read by the computer.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A consumable used in an image forming apparatus that forms an image on a medium, the consumable comprising:
- an image forming material erasable by heat; and
- a storage medium having stored therein information concerning temperature for heating the image forming material,
- the information concerning the temperature including forming temperature, which is temperature for heating the image forming material during image formation, and erasing temperature, which is temperature for heating the image forming material during image erasing, and
- the image forming apparatus including a controller configured to control an image forming operation on the basis of the information concerning the temperature stored in the storage medium and a transmitting section configured to transmit, in response to a request, the information concerning the erasing temperature stored in the storage medium.

2. The consumable according to claim 1, wherein the storage medium is an IC chip, a barcode, a QR code, or an RFID.

3. The consumable according to claim 1, wherein
- the image forming apparatus is an image forming apparatus of an electrophotographic system, and
- the image forming material is a toner.

4. The consumable according to claim 1, wherein
- the image forming apparatus is an image forming apparatus of an inkjet system, and
- the image forming material is liquid ink or gel ink.

5. An image forming apparatus that forms an image on a medium, the image forming apparatus comprising:
- an image forming material erasable by heat;
- a storage medium having stored therein information concerning temperature for heating the image forming material;
- a controller configured to control an image forming operation on the basis of the information concerning the temperature stored in the storage medium; and
- a transmitting section configured to transmit, in response to a request, the information concerning the erasing temperature stored in the storage medium,
- the information concerning the temperature including forming temperature, which is temperature for heating the image forming material during image formation, and erasing temperature, which is temperature for heating the image forming material during image erasing.

6. The apparatus according to claim 5, wherein the storage medium is an IC chip, a barcode, a QR code, or an RFID.

7. An erasing device that erases an image formed on a medium with an image forming material erasable by heat, the erasing device comprising:
- an acquiring section configured to acquire information concerning erasing temperature, which is temperature for heating the image forming material in order to erase the image on the medium;
- a controller configured to control an erasing operation by the erasing device on the basis of the information concerning the erasing temperature; and
- a transmitting section configured to transmit a request signal for requesting the information concerning the erasing temperature, wherein
- the acquiring section acquires the information concerning the erasing temperature from a response signal transmitted in response to the request signal.

8. The device according to claim 7, wherein the storage medium is an IC chip, a barcode, a QR code, or an RFID.

9. An image erasing system comprising:
- an image forming apparatus configured to form an image on a medium; and
- an erasing device configured to erase an image formed on a medium with an image forming material erasable by heat, wherein
- the image forming apparatus includes:
  - the image forming material erasable by heat;
  - a storage medium having stored therein information concerning temperature for heating the image forming material; and
  - a controller configured to control an image forming operation on the basis of the information concerning the temperature stored in the storage medium,
- the information concerning the temperature includes forming temperature, which is temperature for heating the image forming material during image formation, and erasing temperature, which is temperature for heating the image forming material during image erasing, and
- the erasing device includes:
  - an acquiring section configured to acquire the information concerning the erasing temperature, which is the temperature for heating the image forming material in order to erase the image on the medium; and a controller configured to control an erasing operation by the erasing device on the basis of the information concerning the erasing temperature.

* * * * *